US005311801A

United States Patent [19]

Uno

[11] Patent Number: 5,311,801

[45] Date of Patent: May 17, 1994

[54] CUTTING DEVICE

[76] Inventor: Tadao Uno, 1-84, Matsugaoka 1-chome, Chigasaki-shi, Kanagawa-ken, Japan

[21] Appl. No.: 991,966

[22] Filed: Dec. 17, 1992

[30] Foreign Application Priority Data

May 25, 1992 [JP] Japan ..... 4-158568

[51] Int. Cl.[5] ..... B26D 5/20

[52] U.S. Cl. ..... 83/278; 83/276; 83/437

[58] Field of Search ..... 83/207, 276, 277, 278, 83/437, 29, 42, 256, 404

[56] References Cited

U.S. PATENT DOCUMENTS

| | | | |
|---|---|---|---|
| 4,045,944 | 9/1977 | Giori | 53/123 |
| 4,203,334 | 5/1980 | Zettler | 83/277 X |
| 4,448,099 | 5/1984 | Kuroda et al. | 83/23 |
| 4,505,173 | 3/1985 | Hartlage | 83/278 X |
| 4,524,656 | 6/1985 | Del Fabro et al. | 83/23 |

FOREIGN PATENT DOCUMENTS

| | | | |
|---|---|---|---|
| 2431358 | 3/1980 | France | 83/278 |

*Primary Examiner*—Eugenia Jones

*Attorney, Agent, or Firm*—Wenderoth Lind & Ponack

[57] ABSTRACT

A cutting device has a transportation railway for guiding a pile of sheets, a cutter positioned along the transportation railway for cutting a pile of sheets delivered thereto into a plurality of smaller sheets; a first pusher movable along the railway by an operating device from a primary delivery starting position to a primary delivery completion position and engageable with a pile of sheets to be cut for intermittently moving a part of the length of the pile of sheets in the direction of the railway past the cutter where the pile of sheets is cut into piles of smaller sheets. Upon the first pusher reaching the primary delivery completion position, it is retracted to the primary delivery starting position for engagement with a succeeding pile of sheets for moving the succeeding pile of sheets toward the cutter. A second pusher is movable along the transportation railway by an operating device from a secondary delivery starting position coincident with the primary delivery completion position and to a secondary delivery completion position adjacent the cutter and engageable with the firstmentioned pile of sheets for intermittently moving the remainder of the length of the firstmentioned pile of sheets past the cutter for cutting the remainder of the firstmentioned pile of sheets into piles of smaller sheets. Upon the second pusher reaching the secondary completion position, it is retracted to the secondary delivery starting position for engagement with the succeeding pile of sheets for moving the succeeding pile of sheets toward the cutter.

4 Claims, 4 Drawing Sheets

CUTTING DEVICE

BACKGROUND OF THE INVENTION

This invention relates to a cutting device in which piles of sheets spaced at constant distances are intermittently delivered to a cutting means and divided into a plurality of piles of smaller sheets by the cutting means, and particularly to a cutting device which is suitable for efficiently cutting a pile of sheets each bearing a plurality of, for example, banknotes, postcards or the like printed thereon in an orderly manner.

BRIEF DESCRIPTION OF THE PRIOR ART

U.S. Pat. No. 4,045,944 discloses a process for piling a plurality of sheets each bearing a plurality of banknotes printed thereon in an orderly arranged manner, cutting the pile of sheets into piles of smaller sheets, and banding the smaller sheets while the operation of cutting the pile of sheets into smaller sheets is taking place. In an apparatus for carrying out the process of this invention, a pile of sheets is intermittently delivered to a cutting means by a single pusher in order to divide the pile of sheets into piles of smaller sheets. The pile of sheets is not delivered to the cutting means by the single pusher until after completion of the division of the pile of sheets into the piles of smaller sheets.

More specifically, the above-mentioned conventional technique includes a primary division process for dividing the pile of sheets first in a column of units, and a secondary division process for further dividing the pile of sheets onc divided in a column of units, into printing units. In the foregoing prior art, the pile of sheets is delivered to the cutting means by the single pusher both in the primary division process and in the secondary division process, only after completion of the division of the pile of sheets into piles of smaller sheets.

Therefore, in the above conventional technique, it is practically impossible to start delivering the succeeding pile of sheets as soon as the delivery of the preceding pile of sheets to the cutting means is completed. In the aforementioned prior art, the delivery of the succeeding pile of sheets is obliged to be held for at least a time interval during which the pusher is returned from a first position (cutting completion position) where the pusher completes its delivering work for delivering the preceding pile of sheets to a second position where the pusher resumes its delivering work for delivering the succeeding pile of sheets. Therefore, an extensive time loss for delivery results.

This time loss for delivery is accumulated every time the pile of sheets is delivered, and working efficiency of the cutting device is significantly lowered due to the time losses thus accumulated. This eventually greatly deteriorates the performance of the whole operation line including the cutting device.

SUMMARY OF THE INVENTION

It is therefore an object of the present invention to provide a cutting device capable of fundamentally solving the above-described problems inherent in the prior art.

A specific object of the invention is to provide a cutting device, in which a pile of sheets can be divided into piles of smaller sheets in a highly efficient manner.

To achieve the above object, there is essentially provided a cutting device comprising a transportation railway for guided transportation of a pile of sheets by supporting a lower surface thereof, and cutting means for dividing the pile of sheets delivered thereto by said transportation railway into a plurality of piles of smaller sheets, said cutting device further comprising a first pusher for intermittently delivering the pile of sheets a half way into said cutting means so that the pile of sheets is subjected to a primary dividing operation; and a second pusher for delivering the pile of sheets which has been subjected to primary dividing operation, fully into said cutting means so that the pile of sheets is subjected to a secondary dividing operation, one of said first and second pushers, while the other pusher is still engaged in intermittently delivering the pile of sheets into said cutting means, being returned to a delivery starting position in order to standby for the next delivery.

According to the present invention, a pile of sheets is intermittently delivered into the cutting means successively by the first and second pushers, and either the first or the second pusher is returned to the delivery starting position while the other pusher is still engaged in the intermittent delivering operation.

Therefore, the first pusher can immediately start the delivering operation for the succeeding pile of sheets before the completion of the delivering by the second pusher. As a result, the operational time loss experienced in the prior art during the time when the pusher is returned from the position where the pusher completes the delivering-work for a preceding pile of sheets to the position where the pusher starts the delivering-work for the succeeding pile of sheets can be eliminated.

Furthermore, by repeating the delivering operation of the first and second pushers for each pile of sheets, accumulation of time losses can be effectively eliminated and working efficiency of the cutting device can be improved extensively. As a result, performance of the whole line including the cutting device can be increased extensively.

DETAILED DESCRIPTION OF THE EMBODIMENT

One embodiment of the present invention will now be described with reference to FIGS. 1 through 8 inclusive.

Figure 1:
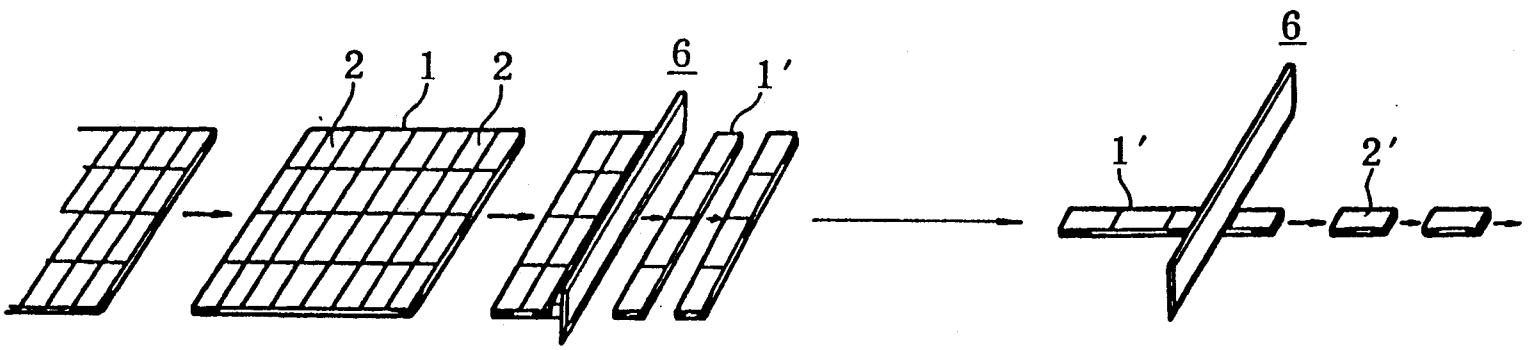
FIG. 1 is a perspective view for schematically explaining the procedure for dividing a pile of sheets first in a column of units and then dividing the columns of units into individual units.

In FIG. 1, the numeral 1 denotes a pile of sheets, on each sheet of which units 2, such as printed units, each having a constant shape are printed in horizontal rows and vertical columns.

The concept of the units 2 each having a constant shape includes, for example, banknotes, postcards, public lottery tickets, checks and various kinds of security papers. These sheets are printed with the numbers in proper order. Then, these sheets are piled up in a predetermined number (for example, 100 sheets) in the order of the numbers to form a series of piles 1 of sheets. The piles 1 of sheets, as shown in FIG. 1, are intermittently delivered to a cutting means 6 and primarily divided into smaller piles of columns 1' of units 2. Then, these piles of columns 1' are intermittently delivered to another cutting means 6, where the piles of columns 1' are further secondarily divided into smaller piles 2' of units 2.

The cutting device of the present invention is suitable for an operation where the pile 1 of sheets is divided into the piles of columns 1' of units, and where the piles of columns 1' are divided into smaller piles 2'.

Therefore, the pile of sheets in the present invention includes a primarily divided form such as the above-mentioned piles of columns 1', but is not limited thereto. It is likewise applicable to a case where the pile of sheets is divided into a plurality of smaller piles.

Figure 7:
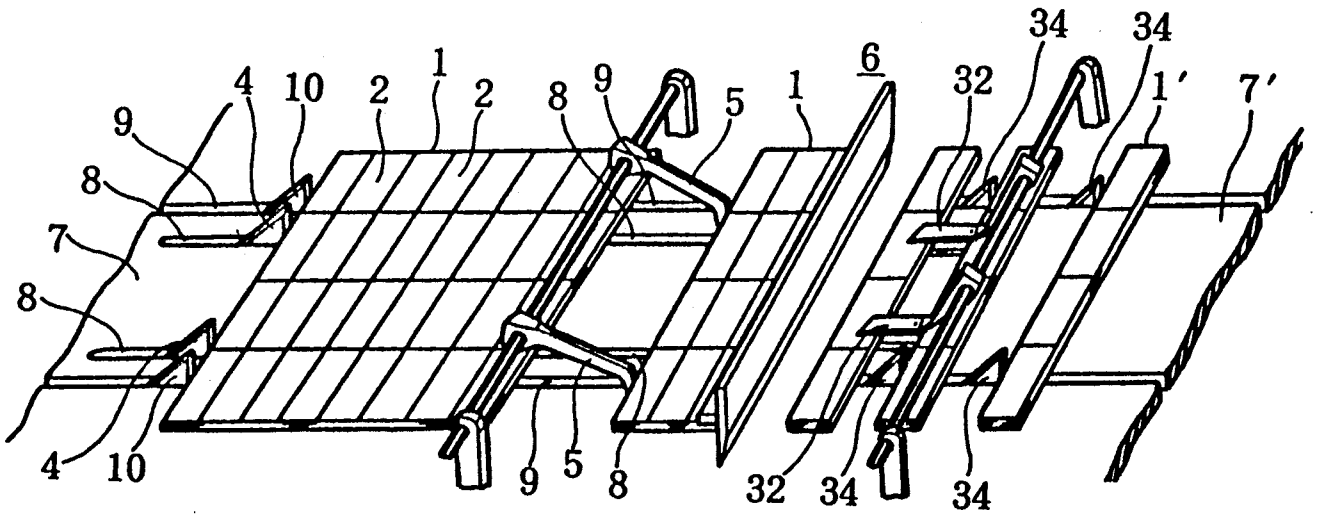
FIG. 7 is a perspective view of the above cutting device.
Figure 8:
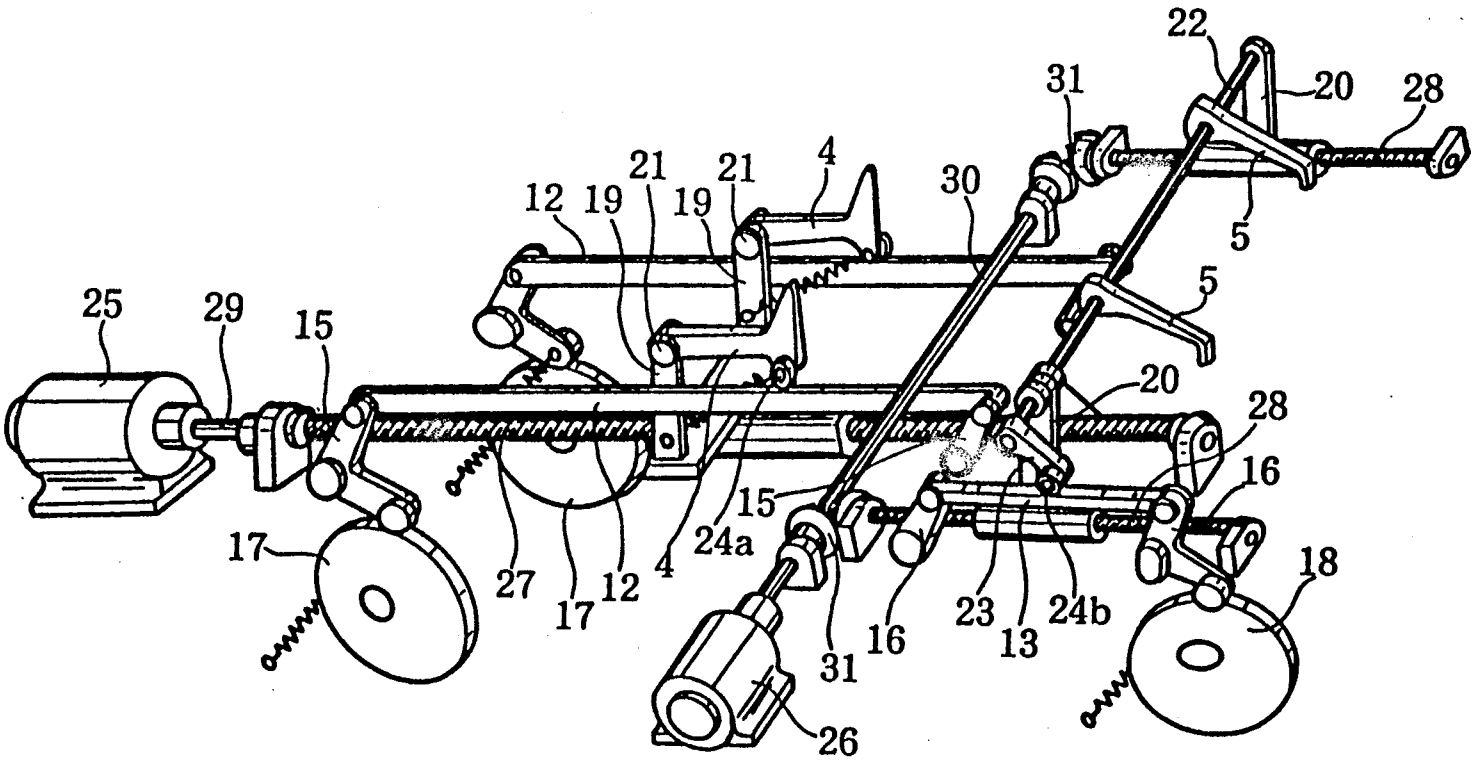
FIG. 8 is a perspective view of the operating mechanisms for the first and a second pushers of the above cutting device.

FIGS. 2 through 6 inclusive show the sequential operations of the cutting device equipped with a first pusher 4 and a second pusher 5. FIGS. 7 and 8 show examples of driving mechanisms for the first and second pushers 4 and 5, and show a representative example of means for dividing the pile 1 of sheets of FIG. 1 into columns of units.

The cutting device includes a cutting means 6 for dividing the pile 1 of sheets into smaller piles, and a transportation railway 7 extending horizontally toward an inlet of the cutting means 6. The pile 1 of sheets has a lower surface thereof supported on an upper surface of the transportation railway 7 for being intermittently delivered to the cutting means 6. In other words, the pile 1 of sheets is intermittently delivered to the cutting means 6 through a distance corresponding to width of the column of units or the width of a single unit, and the cutting means 6 is operated during the time when the delivery is stopped, in order to divide the pile 1 of sheets into piles of columns of units, for example.

The cutting device includes the first pusher 4 and the second pusher 5 as the means for intermittently delivering the pile 1 of sheets. The first pusher 4 undertakes a first partial delivering stroke, for example half of the length of the sheet 1, for the pile i of sheets, while the second pusher 5 undertakes a completion of delivery stroke for the pile 1, for example half of the length of sheet 1. More specifically, the first pusher 1 intermittently repeats its action for delivering the pile 1 of sheets to the cutting means 6 by the width of a single column or a plurality of columns each time, and, while the delivery is stopped, the cutting means 6 is actuated in order to carry out the primary division, namely the division of part of pile 1 of sheets into piles of columns 1' of units.

As soon as the primary division of the first half of the single pile 1 of sheets is completed, the second pusher 5 succeeds the first pusher and continues to deliver the remaining portion of the pile 1 of sheets, which has been primarily divided, in order to carry out the secondary division of the remaining portion of the pile 1 of sheets.

The first pusher 4, while the second pusher 5 is engaged with the work of delivering the remaining portion of the pile 1 of sheets to the cutting means 6, is returned to a primary delivery starting position $P_1$ where it stands by ready for immediately starting the work of delivering the succeeding pile of sheets. On the other hand, the second pusher 5, while the first pusher is engaged with the work for intermittently delivering the pile of sheets, is returned to a secondary delivery starting position $P_2$ where it immediately succeeds the delivery work of the first pusher 4 and continues to intermittently deliver the pile of sheets.

Therefore, the first pusher 4 is reciprocally movable between the primary delivery starting position $P_1$ and a primary delivery completion position which is the same as position $P_2$, while the second pusher 5 is reciprocally movable between the secondary delivery starting position $P_2$ and the secondary delivery completion position $P_3$. And the intermittent delivery work of the first pusher 4 is continued from the secondary delivery starting position $P_2$ by the second pusher 5. Accordingly, the primary delivery completion position for the first pusher 4 is coincident with the secondary delivery starting position $P_2$ for the second pusher 5.

The position $P_2$ where the first and second pushers 4 and 5 meet each other is not limited to a half of the whole delivery distance between $P_1$ and $P_3$. The position $P_2$ may be located anywhere along the whole delivery distance.

It is preferable that the first and second pushers 4 and 5 are reciprocally movable along the transportation railway 7. For example, the first pusher 4 is located on the lower side of the transportation railway 7 so that it can reciprocally move between $P_1$ and $P_2$ along the railway 7. On the other hand, the second pusher 5 is located on the upper side of the transportation railway 7 so that it can reciprocally move between $P_2$ and $P_3$ along the railway 7. However, the apparatus may be designed such that the first and second pushers 4 and 5 are returned to a position slightly rearwardly of $P_1$ and $P_2$, respectively, and then advanced towards $P_1$ and $P_2$, respectively.

In order to properly effect linear movements of the first and second pushers 4 and 5, in other words, in order to properly deliver the pile 1 of the sheets, the railway 7 is provided with grooves 8 and 9 for guiding the linear movements of the first and second pushers 4 and 5. The arrangement is such that pushing ends of the first and second pushers 4 and 5 are brought into engagement with the guide grooves 8 and 9 so that the first and second pushers 4 and 5 are linearly moved along the guide grooves 8 and 9 which regulate the pushing ends of the first and second pushers 4 and 5.

When the first pusher 4 is returned from the primary delivery completion position $P_2$ to the primary delivery starting position $P_1$, the pushing end of the first pusher 4 is moved backwardly while being guided by the guide groove 8, and raised after reaching a rear end face of the succeeding pile I of sheets to a position where it faces the rear end face of the succeeding pile 1 of sheets in order to start the primary delivery.

On the other hand, when the second pusher 5 is returned from the secondary delivery completion position $P_3$ to the secondary delivery starting position $P_2$, the pushing end of the second pusher 5 is moved backwardly along the upper surface of the pile 1 of sheets which is supported by the transportation railway 7 and being primarily divided, and lowered after reaching the rear end face of the pile 1 of sheets to engage in the guide groove 9 and, at the same time, to face the rear end face of the pile 1 of sheets, and then, the second pusher 5 starts the secondary delivery guided by the guide groove 9.

Figure 2:
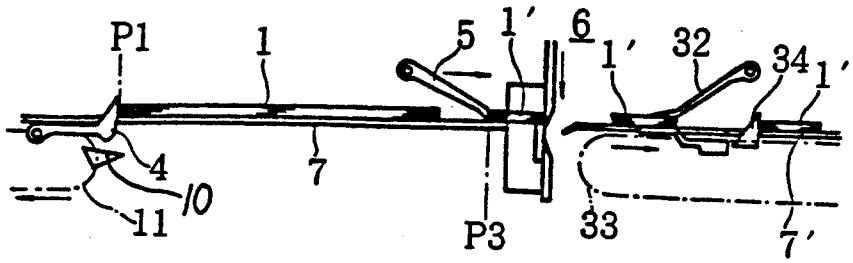
FIGS. 2 through 6 inclusive are side views for explaining the sequential operation of a cutting device according to one embodiment of the present invention.

FIG. 2 shows the primary delivery starting position $P_1$ for the first pusher 4. The pile 1 of sheets is delivered to this position $P_1$ by a third pusher 10. This third pusher 10 is driven by a chain 11 which is endlessly rotated along, for example, the extension of one end of the transportation railway 7, and serves as means for delivering the pile 1 of sheets, which has already been subjected to the preliminary processes such as a printing process and a lug-cutting process.

Next, operating mechanisms for the first and second pushers 4 and 5 will be described with reference to FIGS. 7 and 8.

A pair of first pushers 4 are located side by side in a width direction of the transportation railway 7 such that the pair of first pushers 4 push both sides of the rear end face of the pile 1 of sheets. Likewise, a pair of second pushers 5 are located side by side in a width direction of the transportation railway 7 such that the pair of second pushers 5 pushes both sides of the rear end face of the pile 1 of sheets which has been subjected to the primary cutting work.

As means for moving the first and second pushers 4 and 5 upwardly and downwardly, for example, guide bars 12 and 13 are disposed in parallel relation with the transportation railway 7, both ends of the guide bars 12 and 13 being pivotably connected to swingable arms 15 and 16, the guide bars 12 and 13 being shifted upwardly and downwardly in parallel relation by swinging the swingable arms 15 and 16 by means of cam means 17 and 18 or fluid actuated cylinders or the like.

The first and second pushers 4 and 5 are vertically pivotably mounted at basal portions thereof on supporting posts 19 and 20 on shafts 21 and 22, respectively, so that the parallel shifting motions of the guide bars 12 and 13 are transmitted to the first and second pushers 4 and 5 to cause them to be pivoted upwardly and downwardly.

For example, a rotor 24*a* disposed on the pushing end of the first pusher 4 is supported on the guide bar 12 so that the rotor 24*a* will be moved following the movement of the guide bar 12. Owing to the foregoing arrangement, when the cam means 17 is rotated by a motor, etc., the swingable arm 15 is swung leftwardly and rightwardly. The guide bar 12 operatively connected to the swingable arm 15 is vertically shifted in parallel relation, and the first pusher 4 is swung upwardly and downwardly following the shifting movement of the swingable arm 15 while allowing the rotor 24*a* to rotate along the guide bar 12.

In the primary delivery starting position $P_1$, the first pusher 4 is pivoted upwardly by the vertical operating mechanism so as to face the rear end face of the pile 1 of sheets. This state is maintained until after completion of the primary delivering work. In the primary delivery completion position $P_2$, the first pusher 4 is pivoted downwardly and returned towards $P_1$ away from the rear end face of the pile 1 of sheets.

The basal ends of the pair of second pushers 5 are connected to each other by way of the shaft 22, and a swingable arm 23 is mounted on one end of the shaft 22, and a rotor 24*b* disposed at one end of the swingable arm 23 is supported on the guide bar 13 such that the arm 23 can follow the movement of the guide bar 13. As a consequence, as in the case of the first pusher 4, in accordance with the vertical shifting movement of the guide bar 13, the rotor 24*b* rolls on the guide bar 13 to swing the swingable arm 23 upwardly and downwardly. As a result, the shaft 22 is rotated and the second pushers 5 are pivoted upwardly and downwardly.

In the secondary delivery starting position $P_2$, each second pusher 5 is pivoted downwardly by the vertical operating mechanism so as to face the rear end face of the pile 1 of sheets which has already been subjected to primary dividing, and maintains this state after completion of the secondary delivering work. In the secondary delivery completion position $P_3$, the second pusher 5 is swung upwardly and returned toward the point $P_2$ away from the rear end faces of the final column of units.

Figure 3:
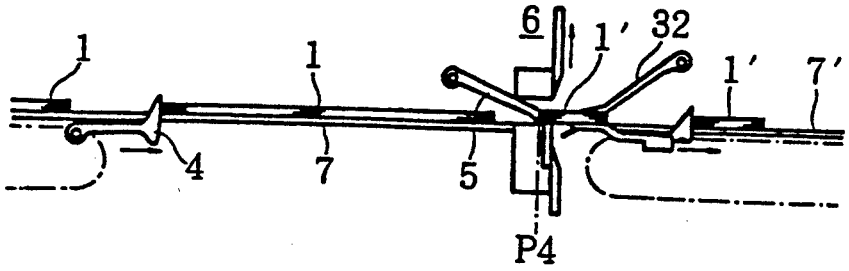

As understood from FIGS. 2 and 3, the second pusher 5 is further moved forwardly from the secondary delivery completion position $P_3$ where the pile 1 of sheets is subjected to secondary dividing by the cutting means 6, in order to deliver the last remaining column of units 1' out towards the next processing side from the cutting means 6. In other words, the second pusher 5 also serves as means for pushing out the last column of units 1' by advancing from the secondary delivery completion position $P_3$ to a tertiary delivery completion position $P_4$.

Therefore, the present invention includes two cases: in one case, the second pusher 5 is returned from the secondary delivery completion position $P_3$ to the secondary delivery starting position $P_2$, and in the other case, the second pusher 5 is returned from the tertiary delivery completion position to the secondary delivery starting position $P_2$. Reference to the secondary delivery completion position is intended to be generic to both the secondary and tertiary delivery completion positions.

The reciprocal moving mechanisms in the respective operations of the first and second pushers 4 and 5 will now be described.

As the mechanisms for reciprocally moving the first and second pushers 4 and 5, in other words, as means for having the first and second pushers 4 and 5 effect the primary delivery and the secondary delivery, respectively, servo motors 25 and 26, and screw shafts 27 and 28 controlled by the motors are used as shown in FIGS. 7 and 8.

Rotation of the servo motors 25 and 26 is transmitted directly or indirectly to the screw shafts 27 and 28 respectively, the screw shafts 27 and 28 being threadedly engaged with the supporting posts 19 and 20 on which the first and second pushers 4 and 5 are mounted, the number of rotations of the screw shafts 27 and 28 being set by the servo motors 25 and 26, thereby setting the amounts of movement of the supporting posts 19 and 22 threadedly engaged with the screw shafts 27 and 28, and the pusher shafts 4 and 5.

FIG. 8 shows one example in which the screw shaft 27 is directly connected to the shaft 29 of the servo motor 25, and a member for interconnecting the supporting posts 19 of the pair of first pushers 4 is threadedly engaged with the screw shaft 27 in order to control the movements of the pair of first pushers 4. Also in the example of FIG. 8, a pair of screw shafts 28 are connected to a shaft 30 of the servo motor 26 through a bevel gear 31, and the supporting posts 20 of the second pushers 5 are threadedly engaged with screw shafts 28 respectively in order to control the reciprocal movements of the pair of second pushers 5.

In other words, FIG. 8 discloses one means for reciprocally moving the pair of pushers by the single screw shaft 27, and another means for reciprocally moving the pair of pushers by the two screw shafts 28.

Next, the construction of the present invention will be described together with its operation with reference to FIGS. 2 to 6 inclusive.

As shown in FIG. 2, from the position indicated by $P_1$, the first pusher 4 pushes the rear end face of the pile 1 of sheets to start the primary delivery work. Owing to this primary delivery, the pile 1 of sheets is intermittently delivered by a dimension corresponding to the width of a column of units.

Figure 4:
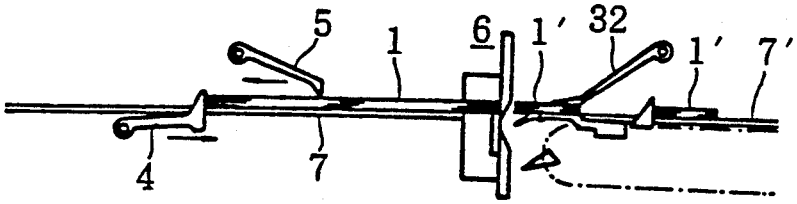

As shown in FIGS. 3 and 4, when the secondary and tertiary delivering operations for the preceding pile 1 of sheets by the second pusher 5 have been completed, the leading end of the pile 1 of sheets is delivered to the cutting means 6 by the first pusher 4, and this cutting means 6 is operated, while the delivering operation is stopped, to cut the frontmost column of units from the sheets in order to divide the sheets into columns 1' of units 2.

Figure 5:
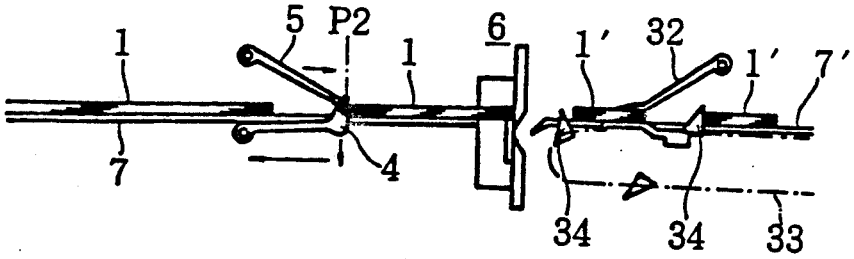

When the first pusher 4 reaches the primary delivery completion position $P_2$ completing the primary delivery and the primary division as shown in FIG. 5, the second pusher 5 takes the place of the first pusher 4 in order to continue the secondary delivery of the remaining part of the pile 1 of sheets, so that the pile 1 of the sheets is subjected to the secondary division by the cutting means 6.

Figure 6:
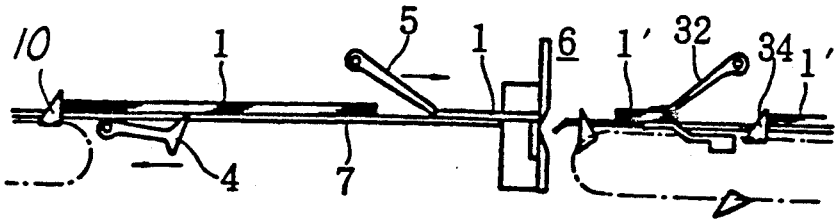

As shown in FIG. 6, during the time when the second pusher 5 effects the secondary delivery, the first pusher 4 is returned to the primary delivery starting position $P_1$ away from the rear end face of the pile 1 of sheets, and during the time when this first pusher 4 is returned to the position $P_1$, the secondary delivery to the cutting means 6 and the secondary division are continued by the second pusher 5.

Before completion of the secondary delivery by the second pusher 5, the first pusher 4, as shown in FIG. 2, is returned to the primary delivery starting position $P_1$ and starts the primary delivery of a succeeding pile 1 of sheets.

As shown in FIGS. 3, 4, and 5, when the secondary delivery has been completed, the second pusher 5 is returned to the secondary delivery starting position $P_2$ while the primary delivery is again made by first pusher 4, in order to take the place of the first pusher 4 to again continue the secondary delivery and secondary division.

Although the secondary delivery for the secondary division made by the second pusher 5 is completed at the position indicated by $P_3$ as previously mentioned, the second pusher 2 is further advanced from this secondary delivery completion position $P_3$ to the tertiary delivery completion position indicated by $P_4$ in order to push out the last pile of columns of units from the cutting means 6, and then returned from this tertiary delivery completion position $P_4$ to the secondary delivery starting position $P_2$.

In this way, the single pile 1 of sheets is delivered to the cutting means alternatively by the first and second pushers 4 and 5, and divided into piles of columns 1' of units 2. These piles of columns 1' are taken out by a gripper 32 mounted on an outlet side of the cutting means 6, and delivered to the next process, for example, a cutting process for dividing the piles of columns 1' into the units 2' by a fourth pusher 34 which is driven by a chain 33.

As mentioned before, the piles of columns 1' can be divided into units 2' by the cutting device of the present invention, too.

A transportation railway 7' is disposed on the outlet side of the cutting means 6, and the fourth pusher 34 is moved along this transportation railway 7', and the piles of columns 1' taken out by the gripper 32 are delivered to the next process.

In the embodiment described above, the first pusher 4 is disposed on the lower side of the transportation railway 7, and the second pusher 5 is disposed on the upper side of the railway 7. However, the present invention includes a modification in which the second pusher 5 is disposed on the lower side of the transportation railway 7, and the first pusher 4 is disposed on the upper side of the railway 7.

As shown in FIGS. 2 and 3, the second pusher 5 is used as means for advancing the last pile of columns 1' from the secondary delivery completing position indicated by $P_3$ to the tertiary delivery completing position indicated by $P_4$ and for pushing out the pile of columns 1' from the cutting means 6. However, the pile of columns 1' may be pushed out by other appropriate means, and the last pile of columns may be pushed out by delivery of the succeeding pile of sheets.

As described in the foregoing, according to the present invention, by cooperative operation of the first pusher and the second pusher, a single pile of sheets is intermittently delivered to a cutting means and divided into piles of columns of small blocks, and the first pusher is returned to the primary delivery starting position before completion of the delivery of the pile of sheets by the second pusher, so that the first pusher can immediately start the delivering operation for the following pile of sheets.

Accordingly, operational time loss occurable during the time when the pusher is returned from the delivery completion position for the preceding pile of sheets to the delivery starting position for the succeeding pile of sheets as in the prior art, can be greatly reduced.

Furthermore, by repeating the alternative delivering operations of the first and second pushers for each pile of sheets, the accumulation of time losses, as in the conventional case where the pile of sheets is delivered by a single pusher, can be reduced effectively, and working efficiency can be increased extensively. As a result, performance of the whole line including the cutting device can be increased extensively.

What is claimed is:

1. A cutting device comprising:

a transportation railway for guiding a pile of sheets by supporting a lower surface thereof;

a cutting means positioned along said transportation railway for cutting a pile of sheets delivered thereto along said transportation railway into a plurality of smaller sheets;

a first pusher movable along said transportation railway from a primary delivery starting position to a primary delivery completion position and engageable with a pile of sheets to be cut for intermittently moving a part of the length of the pile of sheets in the direction of the transportation railway past said cutting means for enabling said cutting means to subject the pile of sheets to a primary cutting operation for cutting the part of the pile of sheets into piles of smaller sheets;

first pusher moving means connected to said first pusher for intermittently moving said first pusher along said transportation railway in a delivery direction and for, upon the first pusher reaching the primary delivery completion position, immediately retracting said first pusher to said primary delivery starting position for engagement with a succeeding pile of sheets and starting intermittent movement of said first pusher for moving said succeeding pile of sheets toward said primary delivery completion position;

a second pusher movable along said transportation railway from a secondary delivery starting position coincident with said primary delivery completion position and to a secondary delivery completion position adjacent said cutting means and engageable with said first mentioned pile of sheets for intermittently moving the remainder of said length of said first mentioned pile of sheets past said cutting means for enabling said cutting means to subject the pile of sheets to a secondary cutting operation for cutting the remainder of said first mentioned pile of sheets into piles of smaller sheets;

second pusher moving means connected to said second pusher for intermittently movingly said second pusher along said transportation railway in a delivery direction and for, upon said second pusher reaching the secondary completion position, immediately retracting said second pusher to said secondary delivery starting position for engagement with the succeeding pile of sheets and starting intermittent movement of said second pusher for moving said succeeding pile of sheets toward said secondary delivery completion position, said second pusher moving means having the operation thereof timed for starting the movement in the delivery direction immediately after said first pusher has reached said primary delivery completion position and carrying out movement of the second pusher in the delivery direction as said first pusher is being retracted and the movement of the succeeding pile of sheets is being started, and carrying out the retracting movement of the second pusher within the time said first pusher completes movement of the succeeding pile of sheets to the primary delivery completion position.

2. A cutting device as claimed in claim 1 wherein one of said pushers is disposed above said transportation railway and the other of said pushers is disposed below said transportation railway.

3. A cutting device as claimed in claim 1 wherein said pushers each comprise a pair of pusher elements spaced laterally across said transportation railway.

4. A cutting device as claimed in claim 1 wherein said second pusher is further movable past said secondary delivery completion position toward said cutting means for pushing a remaining pile of smaller sheets left after a last cutting operation of said cutting means past said cutting means, and said second pusher moving means comprises means for moving said second pusher past said second delivery completion position after completion of the last cutting operation of said cutting means.

* * * * *